United States Patent [19]

Knox

[11] Patent Number: 4,492,523

[45] Date of Patent: Jan. 8, 1985

[54] TOROIDAL INDUCTOR FOR A PRESSURE SENSOR IN A SUBMERSIBLE PUMP

[75] Inventor: Dick L. Knox, Claremore, Okla.

[73] Assignee: Hughes Tool Company, Houston, Tex.

[21] Appl. No.: 579,045

[22] Filed: Feb. 10, 1984

[51] Int. Cl.[3] ..... F04B 49/02; F04B 49/10; F04B 35/04

[52] U.S. Cl. ..... 417/13; 417/414

[58] Field of Search ..... 417/13, 414, 424

[56] References Cited

U.S. PATENT DOCUMENTS

| | | | |
|---|---|---|---|
| 2,002,907 | 5/1935 | Sessions | 417/414 |
| 2,404,783 | 7/1946 | Blom | 417/414 |
| 2,674,194 | 4/1954 | Artunoff | 417/414 |
| 2,682,229 | 6/1954 | Luenberger | 417/414 |
| 3,340,500 | 9/1967 | Boyd . | |
| 4,057,365 | 11/1977 | Colmer | 417/13 |
| 4,387,372 | 6/1983 | Smith et al. . | |
| 4,425,087 | 1/1984 | Gould | 417/414 |

*Primary Examiner*—William L. Freeh

*Attorney, Agent, or Firm*—Robert A. Felsman; James E. Bradley

[57] ABSTRACT

A pressure compensator for a submersible pump has features to prevent damage while lowering the pump into the well. The pressure compensator includes a bellows located below the pump. A retainer will mechanically retain the bellows in a position other than its maximum lubricant volume position while lowering the pump assembly into the well. Once the motor begins operation, the retainer will release the bellows for normal movement. The retainer inlcudes a linkage member that is connected to the top of the bellows and extends upwardly to the drive shaft. A latching device latches the linkage member to the drive shaft. A reverse threaded portion in the latching device unscrews the latching device from the linkage member once the motor begins to rotate. A pressure sensing assembly is coupled between the pressure compensator and the motor. A toroidal inductor in the sensing assembly provides a passage for the linkage member.

3 Claims, 8 Drawing Figures

TOROIDAL INDUCTOR FOR A PRESSURE SENSOR IN A SUBMERSIBLE PUMP

CROSS-REFERENCE TO RELATED APPLICATION

This application is being filed simultaneously with an application titled BELLOWS LATCHING MECHANISM FOR A SUBMERSIBLE PUMP, Mark C. James, which contains common subject matter.

BACKGROUND OF THE INVENTION

1. Field of the Invention

This invention relates in general to submersible pumps for oil and water wells, and in particular to the pressure sensing and compensating system for these types of pumps.

2. Description of the Prior Art

Submersible pumps of the type concerned herein normally have a centrifugal pump that is driven by a submersible electric motor located below the pump. The shaft of the electric motor extends upwardly through a seal section for engaging the centrifugal pump. The seals are located in the seal section for sealing well fluid from the lubricating oil contained in the electric motor. Also, normally an elastomeric pressure compensator or a diaphragm is located in the seal section, with the drive shaft extending through a hole in the center of the compensator. A port exposes the exterior of the compensator to well fluid. The compensator is movable for reducing pressure differential between the well fluid and the lubricant in the motor.

A disadvantage of having the pressure compensator in the seal section is that if it leaks, the well fluid, being often mostly water, would migrate down into the motor, possibly causing damage. Also, having the pressure compensator in the seal section requires that it have a passage through its center for the drive shaft to pass.

Pressure compensators have been located below the motor in the prior art, such as shown in U.S. patent application Ser. No. 267,224, filed May 26, 1981, now U.S. Pat. No. 4,436,488, Witten. If located below the motor, any leakage of well fluid would not likely contaminate the motor, since the well fluid would not migrate upward. However, problems are encountered in installing such an assembly in the well. The weight of the lubricant in the motor while at the surface would tend to move the bellows to a position of maximum lubricant volume. If the assembly is completely filled with lubricant, then when the motor starts to operate, the lubricant will not have any room to expand due to the rise in temperature. This would cause lubricant to be expelled across the seals, possibly causing damage to the seals.

Also, even if the bellows is initially in an intermediate position, leaving room for expansion, another problem might occur. If the assembly is suddenly stopped while lowering into the well, a downrush of lubricant could suddenly move the bellows from an intermediate position to a position of maximum lubricant volume, drawing a vacuum at the top of the seal section, possibly causing well fluid to be drawn in across the seals. In the above-mentioned patent application, a pressure equalizing tube is taught as a solution in one embodiment, and loading the bellows with a counterbalancing fluid is suggested in another embodiment.

Pressure sensing systems are known for use in conjunction with pressure compensating systems. These sensing systems sense lubricant pressure and provide a concurrent surface indication. The systems employ downhole inductors to shield AC power from the pressure transducer. The inductors are large and wound about a straight axis.

SUMMARY OF THE INVENTION

In this invention, a means is provided for securing the bellows in substantially a stationary position while lowering the assembly into the well. The position of the bellows is at a point other than its point of maximum lubricant volume so that when the motor begins to operate, the expansion of the lubricant due to temperature rise will be accommodated by the bellows.

In the preferred embodiment, the bellows is located below the motor and has one end connected to a linkage member that extends upwardly to the drive shaft of the motor. A latch means latches the linkage member to the drive shaft of the motor during assembly. This holds the bellows in a stationary position other than the maximum lubricant volume position. When the motor begins to operate, the latch means releases the linkage member to allow the bellows to freely move up and down to reduce pressure differential between the well fluid and the lubricant in the motor. Preferably, the latch means includes a threaded rod that is secured to the lower end of the drive shaft and engages a nut located within the linkage member. The rod has a threaded portion that engages the nut and is threaded in a direction opposite to the motor rotation. Rotation of the motor unscrews the nut, allowing the linkage member to drop from its engagement with the shaft.

The submersible pump assembly is adapted to be used with a downhole pressure sensor that senses the lubricant pressure and transmits the signal to the surface over the power cables. The pressure sensing assembly includes a housing that is carried by the motor below the motor. At least one inductor is located in the sensor housing and connected between a sensing transducer and a winding of the motor. The inductor shields AC power from the transducer. The inductor is toroidal in configuration with an aperture therethrough. This aperture provides a passage for the retaining means for retaining the bellows in a position other than its maximum lubricant volume position.

FIG's. 2*a*, 2*b* and 2*c* represents the upper, intermediate portion, and lower portion of a pressure compensator assembly for a submersible well pump constructed in accordance with this invention.

Figure 3:
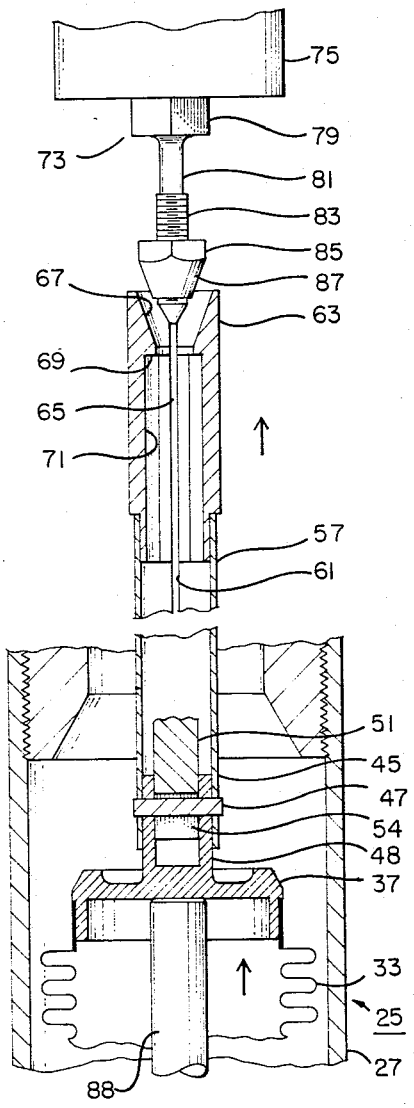

FIG. 3 is an enlarged partially sectioned view of the pressure compensator assembly of FIG's. 2*a*–2*c*, shown in the process of securing the compensator assembly to the motor.

Figure 4:
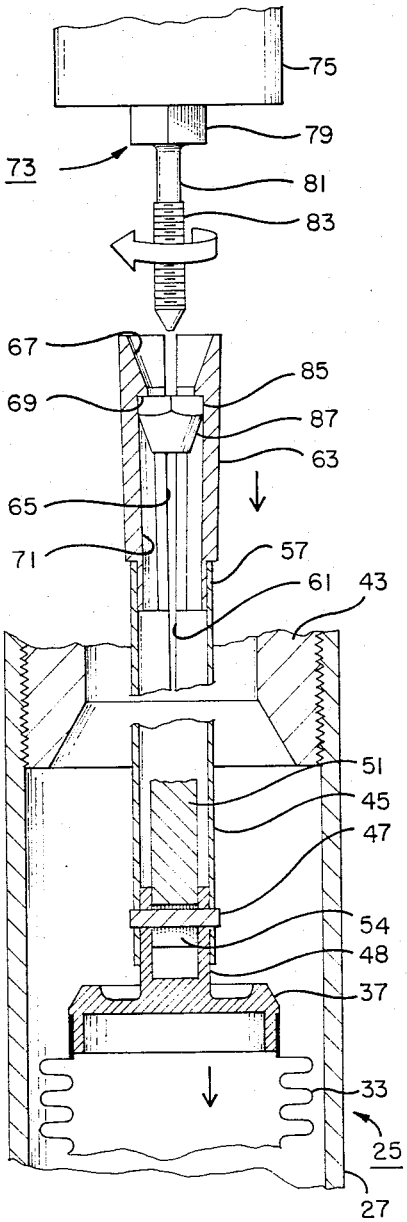

FIG. 4 is a view similar to FIG. 3, but shown when the motor begins to operate.

Figure 5:
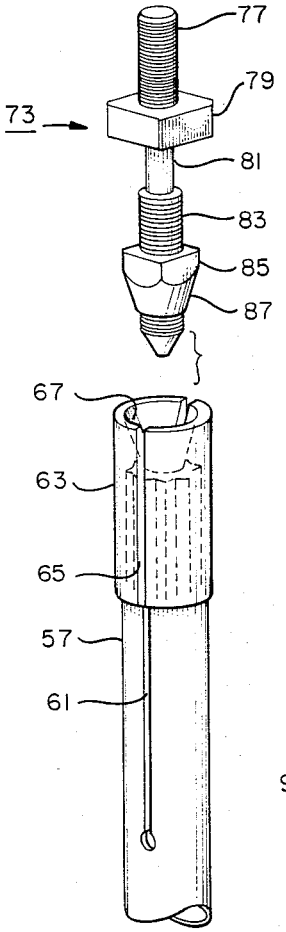

FIG. 5 is a partial perspective view of the latching means for the pressure compensator assembly of FIG's. 2*a*–2*c*.

Figure 6:
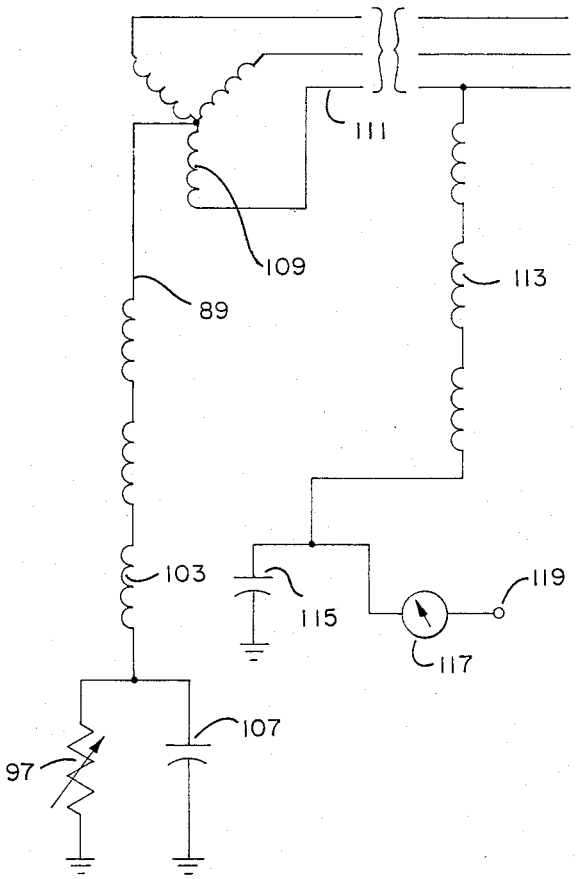

FIG. 6 is an electrical schematic view illustrating the pressure sensing system connected with the submersible pump assembly.

DESCRIPTION OF THE PREFERRED EMBODIMENT

Figure 1:
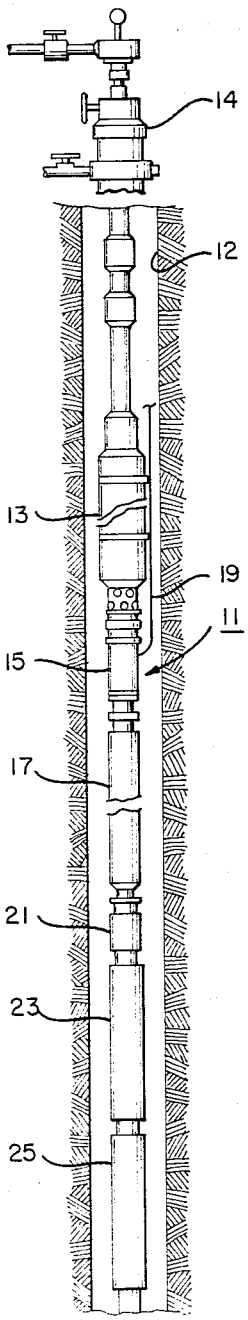
FIG. 1 is a schematic side view of a submersible pump assembly.

Referring to FIG. 1, an electrical submersible pump assembly 11 is shown located in a well 12. The pump assembly 11 includes a centrifugal pump 13 which pumps well fluid to a christmas tree 14 at the surface. Pump assembly 11 has a seal section 15 connected below the centrifugal pump 13, with an electric motor 17 connected to the seal section. The seal section 15 seals the motor 17 from well fluid. Cable 19 extends from the motor 17 to the surface for supplying electrical power to the motor 17. Motor 17 is an AC motor supplied with three phase power.

In the embodiment shown, a shorting plug 21 for tying the windings of the motor is located at the bottom of the motor 17. A pressure sensing assembly 23 is connected to the shorting plug 21. The pressure sensing assembly 23 has components for sensing pressure of the lubricant in the motor, which is approximately that of the well fluid pressure. The pressure sensing assembly 23 provides an electrical response which is superimposed on the power cables 19 for readout at the surface.

A pressure compensating assembly 25 is connected to the bottom of the pressure sensing assembly 23. The pressure compensating assembly 25 contains means for reducing, and preferably equalizing, pressure differential between the well fluid and the lubricant in the motor. Referring to FIG. *2c*, the pressure compensating assembly 25 includes a pressure compensator or bellows housing 27. Housing 27 has a lower end member 29 secured thereto. The end member 29 has a passage 30 that is open when the assembly 11 is in the well for communicating well fluid with the interior of the housing 27. A filler plug 31 is located in a port that extends through the lower end member 29 for introducing lubricant into the motor 17 (FIG. 1), pressure sensing assembly 23 (FIG. 1) and pressure compensating assembly 25.

A bellows 33 is located within the bellows housing 27. Bellows 33 is preferably metal with a generally cylindrical, but expandable and corrugated sidewall 35. The sidewall 35 should have a sufficient hoop strength to avoid collapsing radially under pressure. Inconel or stainless steel is suitable. As shown in FIG. *2b*, an upper end cap 37 is secured to the upper end of the bellows 33. Pressure differential will cause the sidewall 35 to axially contract and lengthen, with the end cap 37 moving upwardly and downwardly. The lower end of bellows 33 is held stationary by means of a retainer 39, which is bolted to the lower end member 29. A stop member 41 comprising a cylindrical tube, is secured to the lower end member 29 and extends upwardly from passage 30 into the bellows 33 for limiting the downward travel of the upper end cap 37 (FIG. *2b*). Stop member 41, being hollow, communicates well fluid with the interior of the bellows 33.

Referring to FIG. *2b*, the upper end of the bellows housing 27 is connected to an adapter 43 that is tubular. A linkage member 45 is rigidly secured to the bellows end cap 37 for movement therewith. Linkage member 45 is a tube that is secured by means of a pin 47 to an upwardly protruding annular neck 48 of end cap 37. Neck 48 is integrally formed with the bellows end cap 37. Linkage member 45 includes on its top a collar 49. Collar 49, and an upper portion of linkage member 45 have two vertical slots (not shown) therethrough which allow them to radially expand. A linkage shaft 51 is adapted to fit within the linkage member 45. Linkage shaft 51 is a solid rod having a reduced neck portion 53 that clips within the collar 49. Collar 49 will expand to receive shaft 51, then contract to retain the shaft 51 when the neck portion 53 is received within the collar 49. The lower end of linkage shaft 51 has an open ended vertical slot 54 for allowing the shaft 51 to slide over the pin 47.

Referring to FIG. *2a*, the linkage shaft 51 extends upwardly through the pressure sensing assembly 23 to an adapter 55, to which it is welded. Adapter 55 is connected rigidly to another linkage member 57 that is identical to the linkage member 45. A pin 59 secures the adapter 55 to the lower end of the linkage member 57. Linkage member 57 has two vertical slots 61 that extend from the upper end downwardly to a point about mid-length. A collar 63 is located at the top of the linkage member 57. Collar 63 is identical to the lower collar 49. As shown in FIG's. 3 and 5, collar 63 has two vertical slots 65 that register with the slots 61 in the linkage member 57. Collar 63 has a downwardly tapered entrance 67 that leads to a downwardly facing internal shoulder 69. Internal shoulder 69 is formed at the upper end of a polygonal bore 71 located in collar 63. Bore 71 preferably has eight sides.

Referring to FIG. 3, a latching rod 73 is secured to the drive shaft 75 for rotation therewith. Latching rod 73 has a threaded upper portion 77 that is screwed into a hole formed in the motor drive shaft 75. As shown in FIG. 5, latching rod 73 has a drive portion 79 in the configuration of a square nut for receiving a wrench to screw the latching rod 73 tightly to the drive shaft 75. The drive portion 79 is integrally formed with the latching rod 73. A reduced diameter neck 81 is located immediately below the drive portion 79. Neck 81 is of lesser diameter than the threaded upper portion 77. A threaded lower portion 83 is larger in diameter than neck 81 and is located below the neck 81. The lower portion 83 is threaded with left hand threads, which are reverse to the normal rotation of the motor. A threaded nut 85 is adapted to be screwed to the threads of the lower portion 83. Nut 85 has a conical portion 87 on its lower end that is adapted to facilitate sliding of the nut 85 into the conical entrance 67 of the collar 63.

In the operation of the pressure compensating system, the pressure sensing assembly 23 and the pressure compensating assembly 25 are normally shipped to the field detached from the motor 17 and the pump 13. At the well site, latching rod 73 is connected to drive shaft 75 and nut 85 is screwed on threaded portion 83. Then the pressure sensing assembly 23 and the pressure compensating assembly 25 are coupled to the electric motor 17 and centrifugal pump 13. Lubricant is introduced conventionally through the passage that receives filler plug 31 by first evacuating the lubricant regions of air, then introducing the lubricant. Filler plug 31 is then secured to retain the lubricant.

Before lowering into the well, and either before or after filing the downhole pump assembly with lubricant, bellows 33 is latched into an upper position. This position is a position of substantially minimum lubricant volume and is shown in FIG's. *2a*, *2b* and *2c*. The pressure compensator housing 27 has in this position substantially the smallest amount of space for containing lubricant. In this position, the bellows 33 will be expanded to practically the extreme, although, as shown in FIG. *2b*, a slight amount of movement of the end cap 37 upward within the adapter 43 is possible. In the opposite position, which is of maximum lubricant volume (not shown), the bellows 33 will be fully compressed, with end cap 37 resting on stop 41 (FIG. 2*c*).

To secure the bellows 33 in the upper position, as shown in FIG. 3, a rod 88 is manually inserted from the passage 30 of the lower end member 29 (FIG. 2*c*) by an operator. Rod 88 bumps against the metal end cap 37 and pushes it upwardly. This moves the linkage members 45 and 57 and the linkage shaft 51 in unison upward with the end cap 37. As the upper collar 63 engages the nut 85, the collar 63 will radially expand to allow the nut 85 to slide within. The slots 61 and 65 define fingers in linkage member 57 and collar 63 to grip the nut 85. The nut 85 will locate below the shoulder 69, at which point the collar 63 and linkage member 57 will contract to clip around the nut 85. Rod 88 is then withdrawn. In this position, the shoulder 69 will prevent any downward movement of the collar 63 with respect to the nut 85. A slight amount of upward movement until end cap 37 contacts the bore of adapter 43 (FIG. 2*b*) is allowed. The polygonal bore 71 will prevent any rotation of the nut 85 with respect to the collar 63, but will let nut 85 slide downwardly with respect to the collar 63.

As the pump assembly 11 is lowered into well, well fluid will enter through passage 30 (FIG. 2*c*) to the interior of bellows 33. The pressure of the well fluid will be transmitted to the lubricant located in the annular space between the bellows 33 and the pressure compensating housing 27. This lubricant is in communication with lubricant in the pressure sensing assembly 23, as well as the lubricant in the motor 17 and the seal section 15. The lubricant is substantially incompressible. The bellows 33 reduces and preferably equalizes any pressure differential between the well fluid and the lubricant. If to compensate while lowering into the well, the bellows need to expand more, a slight amount of upward movement of the end cap 37 is possible because of the clearance space between the end cap 37 and the adapter 43.

Once the pump is properly located at its desired depth, and the motor begins to rotate, the latching rod 73 will unscrew from the nut 85, as shown in FIG. 4. This occurs because of the rotation of the motor 17 being in reverse to the threads of the lower portion 83. Once unscrewed, the linkage members 57 and 45 and the linkage shaft 51 are free to drop downwardly. As the motor begins to heat up, it will heat the oil, causing it to thermally expand and move the end cap 37 downwardly to accommodate for the thermal expansion. As lubricant is depleted during use, the end cap 37 will move upwardly. The nut 85 will be harmlessly located within the linkage member 57, and the latching rod 73 will harmlessly rotate with the drive shaft 75.

In some wells, the high temperature of the well may cause the lubricant to expand significantly prior to starting of the motor to a point such that it might damage the seals or the bellows 33. Expansion in the lubricant areas will tend to compress bellows 33 and exert a downward force on the end cap 37 and the linkage member 57. If the pressure becomes sufficiently high, the neck 81 of the latching rod 73 is sized to break or part, releasing the linkage member 57 to increase the volume for the lubricant and lower the pressure differential. In such a case, the starting of the motor, of course would have no effect, since the threaded portion 83 would be parted from the portion 77 of the latching rod 73 that is secured to the drive shaft 75.

In many submersible pump assemblies, the pressure sensing assembly 23 is not used. The retaining means for retaining the bellows 33 in the upper position while lowering into the well is constructed such that it will operate whether or not there is a pressure sensing assembly 23. Referring to FIG's. 2*a* and 2*b*, if there is no pressure sensing assembly 23, the shaft 51 will not be used, nor will the upper linkage member 57 or collar 63. Rather, in this position, the collar 49 and linkage member 45 will engage the nut 85, in the same manner as previously described in connection with upper collar 63 and linkage member 57. The adapter 43 at the top of the bellows housing 27 will connect directly to the shorting plug 21. The length of the linkage member 45 (FIG. 2*b*) is selected such that after adapter 43 is secured to shorting plug 21, rod 88 (FIG. 3) may be inserted to push the end cap 37 upward to latch the bellows 33 in the upward position in the same manner as previously described. Bellows 33 will delatch on operation of the motor or upon excessive internal pressure, as previously described.

In the preferred embodiment, the elongated member comprising linkage members 45 and 57, and collars 49 and 63, along with latching rod 73 and nut 85 serve as retaining means for mechanically retaining the pressure compensator or bellows 33 in a position other than the maximum lubricant volume position while lowering the pump assembly 11 into the well 12, and for releasing the bellows 33 for movement during operation of the motor 17. More specifically, the collar 63, nut 85 and latching rod 73 serve as means for securing the linkage member 57 to prevent substantial movement of the end 37 of the bellows 33 while the pump assembly 11 is being lowered into the well 12, and for releasing the linkage member 57 once the motor 17 begins operating.

Figure 2A:
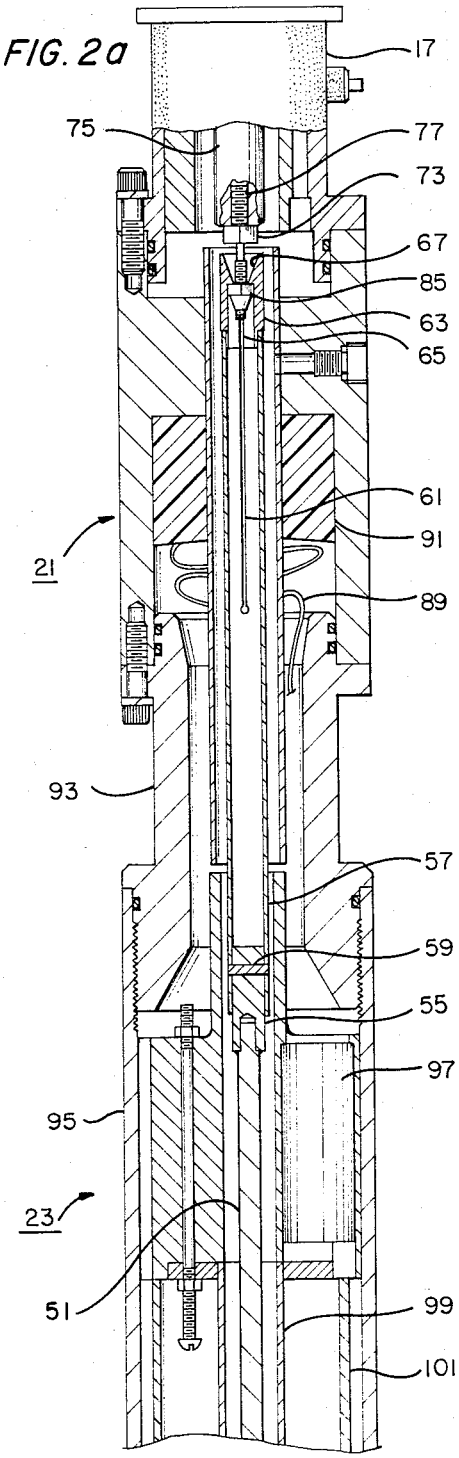

Referring to FIG. 2*a*, the pressure sensing assembly 23 communicates with the surface by means of a wire 89. Wire 89 extends from an epoxy section 91 that is located in the shorting plug 21. Wire 89 is connected to the windings (not shown) of the motor 17, which are tied together in shorting plug 21. Wire 89 extends through an adapter 93 into a pressure sensor housing 95. Housing 95 is tubular and contains a transducer 97 located within a cylindrical body. Transducer 97 is a conventional type that senses pressure of the lubricant within the housing 95 and provides an electrical response corresponding thereto.

Figure 2B:
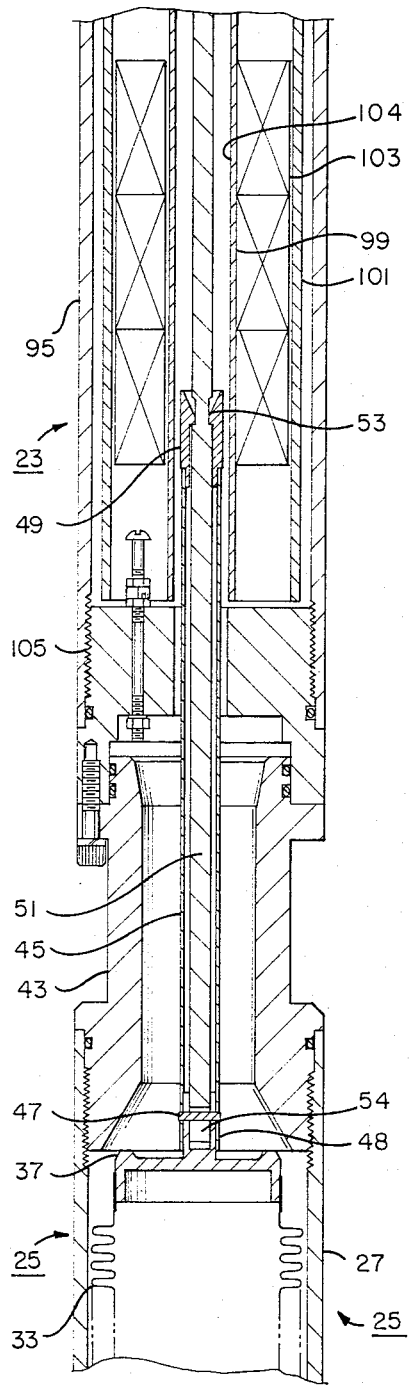
Figure 2C:
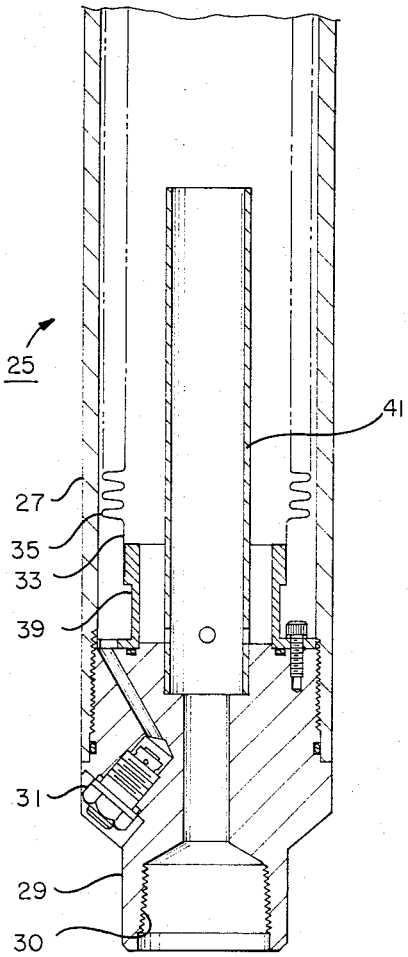

Referring to FIG. 2*b*, three commercially available inductors 103 are shown mounted below the transducer 97 between inner and outer concentric tubes 99 and 101. The inductors 103 are connected in series to wire 89 (FIG. 2*a*) which leads to the motor windings. The transducer 97 is connected to the side of inductors 103 opposite wire 89. The inner and outer tubes 99 and 101 and inductor 103 are contained within the lubricant located in the pump assembly 11. The inductors 103 serve as part of an electrical filter means, and normally at least two will be required. Each inductor 103 is toroidal in shape, or annular. The coil of each inductor 103 is wound about a circular axis. Each inductor 103 has a passage 104 that has an axis that coincides with the axis of the pump assembly 11. Passage 104 closely receives the inner tube 99. The outer diameter of each inductor 103 contacts outer tube 101. The shaft 51 passes through the inner tube 99. The pressure sensor housing 95 has a lower end member 105 that has a passage through it for receiving the lower linkage member 45. The adapter 43 of the pressure compensating assembly 25 is adapted to be secured by bolts to the lower end member 105.

As shown in FIG. 6, the pressure sensing assembly is conventional. The transducer 97 is connected to ground and is in parallel with a capacitor 107. The inductors 103, are connected in series to wire 89, which is connected to the motor windings 109. The motor would usually be connected in wye with wire 89 connected to the common. The three power cables 111 for three phase power lead to the surface and interconnect with a source of AC power. At the surface, three inductors 113, electrically similar to the inductors 103, lead to a capacitor 115, which is connected to ground. A meter 117 senses DC current which is supplied by a DC current source 119.

In the operation of the pressure sensing system, DC current applied by the DC source 119 is superimposed on the power cables 111 and flows through the transducer 97 to ground. The inductors 103 and 113 and the capacitors 107 and 115 shield the transducer 97 and the meter 117 from the high AC power. The toroidal shaped inductors 103 serve as filter means, along with the capacitor 107 for filtering the AC power from the transducer 97.

The invention has significant advantages. The use of toroidal inductors in the downhole sensor allows a retaining means for mechanically retaining the end of the bellows in an upper stationary position. The toroidal inductor provides a passage to allow the linkage member to extend through the passage.

While the invention has been shown in only one of its forms, it should be apparent to those skilled in the art that it is not so limited but is susceptible to various changes without departing from the scope of the invention.

I claim:

1. A submersible pump assembly, comprising in combination:

a pump;

an electrical motor located below the pump and having a drive shaft for rotating the pump, the motor being filled with lubricant;

a sensor housing carried by the motor below the motor;

at least one inductor located in the sensor housing and connected between a transducer for measuring a physical parameter and a winding of the motor, for shielding AC power from the transducer, the inductor having a toroidal configuration with an aperture therethrough, defining a longitudinal passage;

a pressure compensator carried by the motor below the motor and in communication with lubricant of the motor;

a bellows located in the pressure compensator housing, separating lubricant from well fluid, the bellows having an end and an axially expansible sidewall that allows the end to move between an upper position and a lower position to reduce pressure differential between lubricant and well fluid; and retaining means for mechanically preventing the end of the bellows from moving to the lower position while lowering the pump assembly in the well, and for releasing the pressure compensator for free movement during operation of the motor, the retaining means including an elongated member that engages the end of the bellows and passes through the longitudinal passage of the inductor.

2. A submersible pump assembly, comprising in combination:

a pump;

an electrical motor located below the pump and having a drive shaft for rotating the pump, the motor being filled with lubricant;

a sensor housing coupled to the bottom of the motor;

at least one inductor located in the sensor housing and connected between a sensing transducer and a winding of the motor, for shielding AC power from the transducer, the inductor having a toroidal configuration with an aperture therethrough, the axis of which coincides with the axis of the pump assembly;

a pressure compensator housing coupled to the bottom of the sensor housing and in communication with lubricant of the motor, the pressure compensator housing having an open lower end and exposed to well fluid;

a bellows located in the pressure compensator housing, separating lubricant from well fluid, the bellows having an end and an axially expansible sidewall that allows the end to move upwardly and downwardly to reduce pressure differential between the lubricant and well fluid;

a rigid linkage member secured to the end of the bellows and extending upwardly through the aperture in the inductor; and latch means for latching the linkage member to the drive shaft to prevent downward movement of the end of the bellows with respect to the pump assembly while the pump assembly is being lowered into the well, and for releasing the linkage member from the drive shaft once the drive shaft starts to rotate, to allow the end of the bellows to move downward.

3. A submersible pump assembly having a pump, an electrical motor located below the pump and having a drive shaft for rotating the pump, the motor being filled with lubricant, an improved combination comprising:

a sensor housing coupled to the bottom of the motor in communication with the lubricant in the motor;

transducer means located in the sensor housing for sensing the pressure of the lubricant and providing an electrical response thereto;

at least one inductor located in the sensor housing and connected between the transducer means and a winding of the motor for shielding AC power from the transducer means, the inductor being toroidal in configuration with an aperture therethrough, the axis of which coincides with the axis of the pump assembly;

a tube stationarily mounted in the sensor housing, extending longitudinally through the sensor housing and through the aperture in the inductor;

a pressure compensator housing coupled to the bottom of the sensor housing and in communication with the lubricant of the sensor housing and the motor, the pressure compensator housing having an open lower end exposed to well fluid;

a bellows located in the pressure compensator housing, separating lubricant from well fluid, the bellows having an end and an axially expansible sidewall that allows the end to move upwardly and downwardly to reduce pressure differential between the lubricant and well fluid;

a rigid linkage member secured to the end of the bellows and extending upwardly through the aperture in the inductor; and latch means for securing the linkage member to the drive shaft while the pump assembly is at the surface to prevent downward movement of the end of the bellows with respect to the pump assembly while the pump assembly is being lowered into the well, and for releasing the linkage member from the drive shaft once the drive shaft starts to rotate, to allow the end of the bellows to move.

* * * * *